US006474115B1

(12) United States Patent
Preston et al.

(10) Patent No.: US 6,474,115 B1
(45) Date of Patent: Nov. 5, 2002

(54) SHAFT SEAL SYSTEM WITH LEAK MANAGEMENT

(75) Inventors: A. Duane Preston, New Prague, MN (US); Jon R. Turner, Lakeville, MN (US)

(73) Assignee: Chart Inc., Burnsville, MN (US)

( * ) Notice: Subject to any disclaimer, the term of this patent is extended or adjusted under 35 U.S.C. 154(b) by 36 days.

(21) Appl. No.: 09/716,098

(22) Filed: Nov. 17, 2000

(51) Int. Cl.[7] ..... D06F 43/02
(52) U.S. Cl. ..... 68/140
(58) Field of Search ..... 68/5 C, 18 R, 68/18 C, 24, 140; 277/401, 408

(56) References Cited

U.S. PATENT DOCUMENTS 3,613,406 A * 10/1971 Toth ..... 68/140
4,170,556 A 10/1979 Pall
4,708,711 A * 11/1987 Scherer ..... 277/401 X
5,013,051 A 5/1991 Hilaris et al.
5,375,426 A 12/1994 Burgener
5,499,902 A 3/1996 Rockwood
5,813,674 A 9/1998 Dickie et al.
5,893,564 A 4/1999 Yang
5,904,737 A 5/1999 Preston et al.
5,934,683 A 8/1999 Sieghartner
5,943,721 A 8/1999 Lerette et al.
5,997,004 A 12/1999 Braun et al.
6,233,772 B1 * 5/2001 McClain et al. ..... 68/18 R X

* cited by examiner

*Primary Examiner*—Philip Coe
(74) *Attorney, Agent, or Firm*—Piper Rudnick; R. Blake Johnston

(57) ABSTRACT

A cartridge housing surrounds a shaft for rotating a basket within the pressurized cleaning vessel of a dry cleaning system that utilizes liquid carbon dioxide as a solvent. Primary and secondary seals are disposed between the cartridge housing and the shaft in a spaced relationship so that a primary chamber is defined. A final seal is also disposed between the cartridge housing and the shaft and spaced from the secondary seal so that a secondary chamber is defined. The primary chamber houses an inboard bearing while the secondary chamber houses an outboard and thrust bearings. Primary and secondary tanks containing supplies of oil communicate with the primary and secondary chambers, respectively, via their head spaces and wet sides. As a result, the bearings are lubricated. Solvent leaking across the primary seal is vaporized and delivered to the head space of the primary tank so that the pressure differential across the primary seal is reduced. The secondary tank operates in a similar fashion for solvent leaks across the secondary seal. Vaporized solvent from the tank head spaces is routed back to the cleaning vessel when the cleaning vessel de-pressurizes.

27 Claims, 2 Drawing Sheets

SHAFT SEAL SYSTEM WITH LEAK MANAGEMENT

BACKGROUND OF THE INVENTION

The invention relates generally to carbon dioxide dry cleaning systems, and, more particularly, to a shaft seal system for carbon dioxide dry cleaning systems that utilize rotating baskets to agitate the items being cleaned.

Due to environmental, health and safety concerns, dry cleaning systems that utilize liquid carbon dioxide as a solvent instead of perchloroethylene ("perc") or petroleum-based solvents have grown in popularity. Liquid carbon dioxide is an inexpensive and unlimited natural resource and is non-toxic, non-flammable and does not produce smog. It does not damage fabrics or dissolve common dyes and exhibits solvating properties typical of more traditional solvents.

Dry cleaning systems require that liquid carbon dioxide be maintained at a temperature of approximately 50–60° F. to enhance solvent properties. This temperature range corresponds to a pressure range of 680–700 psig. As a result, the cleaning vessel, piping and all associated components of liquid carbon dioxide dry cleaning systems must be designed to operate at high pressure.

In order to minimize the wrinkling that may occur in some materials and to better recover carbon dioxide during the gas recovery/drying cycle, it is desirable to place the items being cleaned in a basket that rotates within the cleaning vessel. The high pressure requirements of carbon dioxide systems, however, have made the provision of a rotating basket problematic. For example, conventional dry cleaning systems often use a shaft connected between the basket and an appropriate electromechanical drive system. The shaft must therefore pass through the wall of the cleaning vessel. As a result, difficulties in preventing high pressure carbon dioxide from escaping around the shaft have been encountered. Alternatives, such as rotating the basket through a magnetic coupling, have been found to be impractical. This is especially true in the case of large, commercial-sized cleaning systems.

U.S. Pat. No. 5,943,721 to Lerette et al. discloses a carbon dioxide dry cleaning system with a rotating basket and a shaft seal arrangement that attempts to overcome some of the difficulties of the prior art systems. The shaft of the Lerette et al. '721 patent is supported by a pair of bearings that are spaced with respect to each another and the cleaning vessel. A dual-seal arrangement surrounds the shaft as it passes through the rear wall of the cleaning vessel. An annular sealant chamber is defined between the two seals and is provided with pressurized sealant fluid at a pressure approximately 500 psig below the pressure of the wash fluid in the cleaning vessel. As a result, the pressure across each of the two seals is substantially less than the pressure differential between the pressure within the cleaning vessel and atmospheric pressure.

A disadvantage of the system of the Larette et al. '721 patent, however, is that the bearings supporting the shaft are positioned outside of the cleaning vessel and, therefore, at a significant distance from the basket. Such an arrangement causes premature bearing wear and bearing maintenance issues.

Bearings require some form of lubrication. Oil typically is used. Carbon dioxide is a very aggressive solvent of oil, however, and, as such, proper measures must be taken to ensure that bearings positioned within the cleaning vessel are properly lubricated and protected from carbon dioxide leaks. The Larette et al. '721 patent and the prior art do not effectively address this issue.

The system of the Larette et al. '721 patent also fails to provide an arrangement whereby leakage of carbon dioxide solvent from the cleaning vessel through the shaft seal may be easily detected and managed. Failure to control such leaks could result in the interruption of the dry cleaning operation.

Other prior art sealing arrangements include dual seals with sealant chambers in between with and without a barrier fluid and with and without pressurization. In addition, the prior art includes labyrinth seals whereby the labyrinth space between a pair of seals is filled with an inert gas at a pressure higher than the pressure in the cleaning vessel. As a result, if seal leakage occurs, a small quantity of harmless inert gas leaks into the cleaning vessel and/or the atmosphere. The space between the seals in such an arrangement, however, could not accommodate oil for lubricating bearings. More specifically, if leakage of the seal between the sealant chamber and the cleaning vessel occurred, oil would be forcibly leaked in the cleaning vessel resulting in contaminated cleaning fluid. In addition these prior art systems fail to resolve the bearing and leak detection and management issues described previously.

Accordingly, it is an object of the present invention to provide a reliable shaft seal system for a liquid carbon dioxide dry cleaning system.

It is another object of the present invention to provide a shaft seal system for a liquid carbon dioxide dry cleaning system that permits a shaft bearing to be placed close to a rotating basket and that provides proper lubrication for the bearing.

It is another object of the present invention to provide a shaft seal system that facilitates the detection of leakage.

It is still another object of the present invention to provide a shaft seal system that manages leaks.

It is still another object of the present invention to provide a shaft seal system that is easy to service and maintain.

SUMMARY OF THE INVENTION

The present invention is directed to a system for sealing a shaft that rotates a basket in the pressurized cleaning vessel of a dry cleaning system of the type that utilizes liquid carbon dioxide as a solvent. The system features a cartridge housing surrounding the shaft as it enters the cleaning vessel with a primary seal disposed between the shaft and the cartridge housing. A secondary seal is also disposed between the shaft and the cartridge housing and is spaced from the primary seal so that a primary chamber is defined therebetween. A final seal is disposed between the shaft and the cartridge housing and is spaced from the secondary seal so that a secondary chamber is also formed. The primary and secondary chambers are at atmospheric pressure when the primary and secondary seals are fully intact. Inboard and outboard bearings for supporting the shaft are positioned within the primary and secondary chambers, respectively. A thrust bearing is also positioned within the secondary chamber.

Primary and secondary tanks containing a lubricating fluid, such as oil, are connected by both their wet sides and head spaces to the primary and secondary chambers, respectively. As a result, the inboard, outboard and thrust bearings are lubricated. Solvent leaking from the cleaning vessel across the primary seal into the primary chamber is vaporized and routed to the head space of the primary tank thus reducing the pressure differential across the primary seal. Similarly, leaks of solvent across the secondary seal are routed to the head space of the secondary tank also reducing the differential pressure across the seal. A pressure switch having a low pressure setting is in communication with the secondary chamber and a signal device so that the signal device is activated when the pressure within the secondary chamber exceeds the pressure setting of the pressure switch. As such, the signal device provides an indication of leakage across the secondary seal. Pressure gauges are also in communication with the chambers and indicate the presence and severity of leaks. Lines featuring check valves are in communication between the head spaces of the primary and secondary tanks and the cleaning vessel so that solvent vapor leaked into the primary and secondary tanks and stored there until the cycle ends may be returned to the cleaning vessel when it is depressurized. This also is to prevent oil from being forced into the cleaning chamber. A vacuum pump removes the air from the cleaning vessel at the beginning of each cycle. As pressure enhanced seals are effective in only one direction, without the check valve, oil could be drawn into the cleaning vessel by action of the vacuum pump.

The following detailed description of embodiments of the invention, taken in conjunction with the appended claims and accompanying drawings, provide a more complete understanding of the nature and scope of the invention.

DESCRIPTION OF THE PREFERRED EMBODIMENTS

Figure 1:
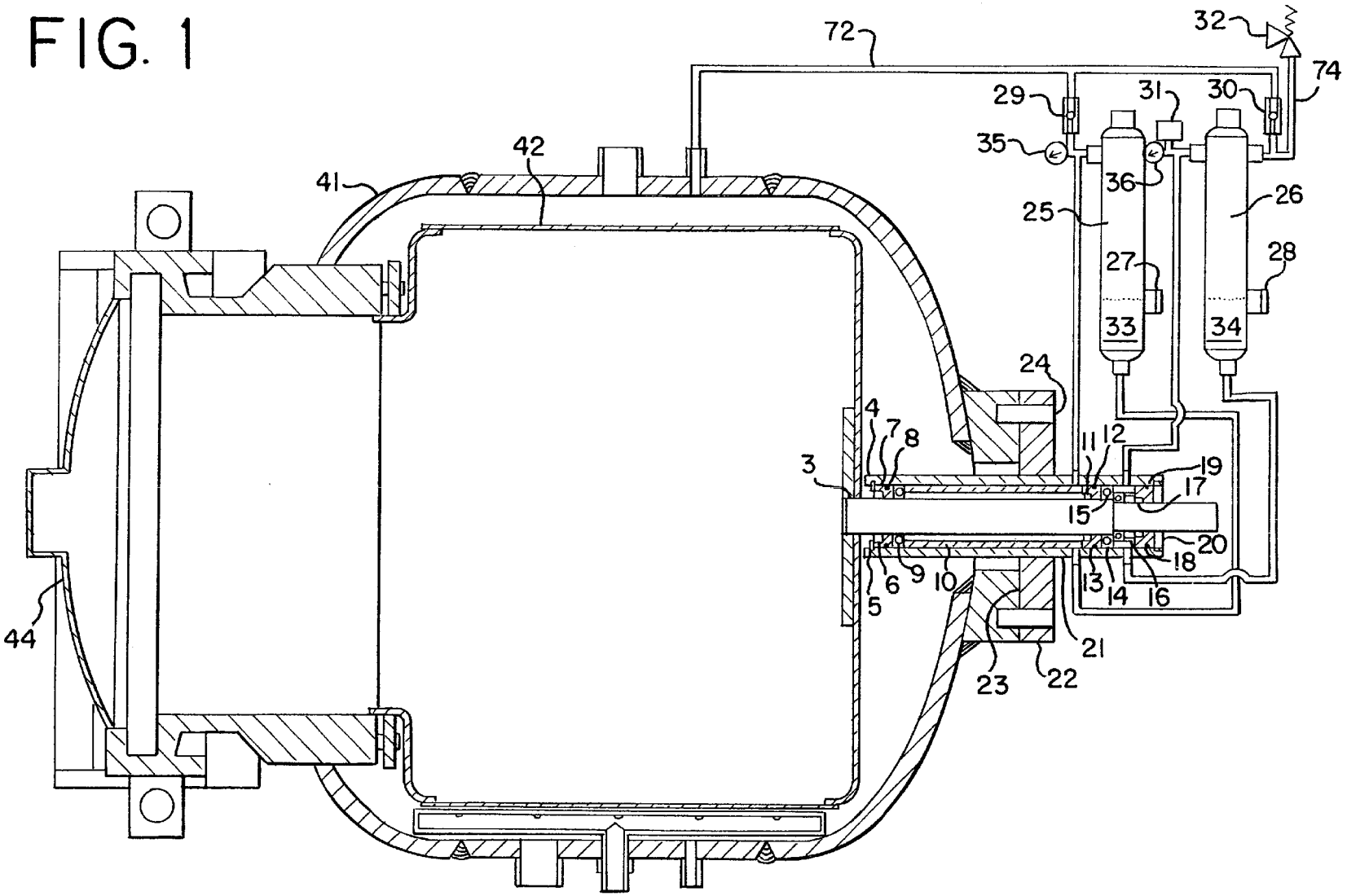
FIG. 1 is a schematic diagram illustrating the cleaning vessel of a liquid carbon dioxide dry cleaning system equipped with an embodiment of the shaft seal system with leak management of the present invention.

With reference to FIG. 1, a cleaning vessel 41 of a liquid carbon dioxide dry cleaning system houses a rotating basket 42. Items to be cleaned, such as clothing, mechanical parts that require de-greasing or other items, are inserted into the cleaning vessel and basket through vessel door 44. When door 44 is closed and latched, cleaning vessel 41 is generally sealed. The rotating basket tumbles or agitates the items placed therein to enhance cleaning and minimize wrinkling (in the case of clothing) and so that the carbon dioxide solvent trapped in the items, for example, between the fibers of clothing, may be more effectively recovered during the system gas recovery and drying cycle.

Once the items to be cleaned are placed within the basket, and the cleaning vessel is sealed, the air is removed from the chamber with a vacuum pump (not shown), the chamber is pressurized with carbon dioxide gas, and then liquid carbon dioxide at a temperature of approximately 50–60° F. and a temperature of 680–700 psig is introduced into the cleaning vessel. Liquid carbon dioxide at such a temperature and pressure features enhanced solvent properties. The basket is then rotated to agitate and clean the items therein.

Once the wash cycle is completed, the liquid carbon dioxide is drained from the cleaning vessel and the pressure therein is reduced. Pressurized gas, such as carbon dioxide or another type of gas, is introduced into the cleaning vessel as the items are again agitated via the rotating basket. As a result, during this gas recovery and drying cycle, the liquid carbon dioxide solvent remaining in the items is vaporized and released for recovery by the system.

For additional details regarding liquid carbon dioxide dry cleaning systems, reference may be had to commonly owned U.S. Pat. No. 5,904,737 to Preston et al.

Figure 2:
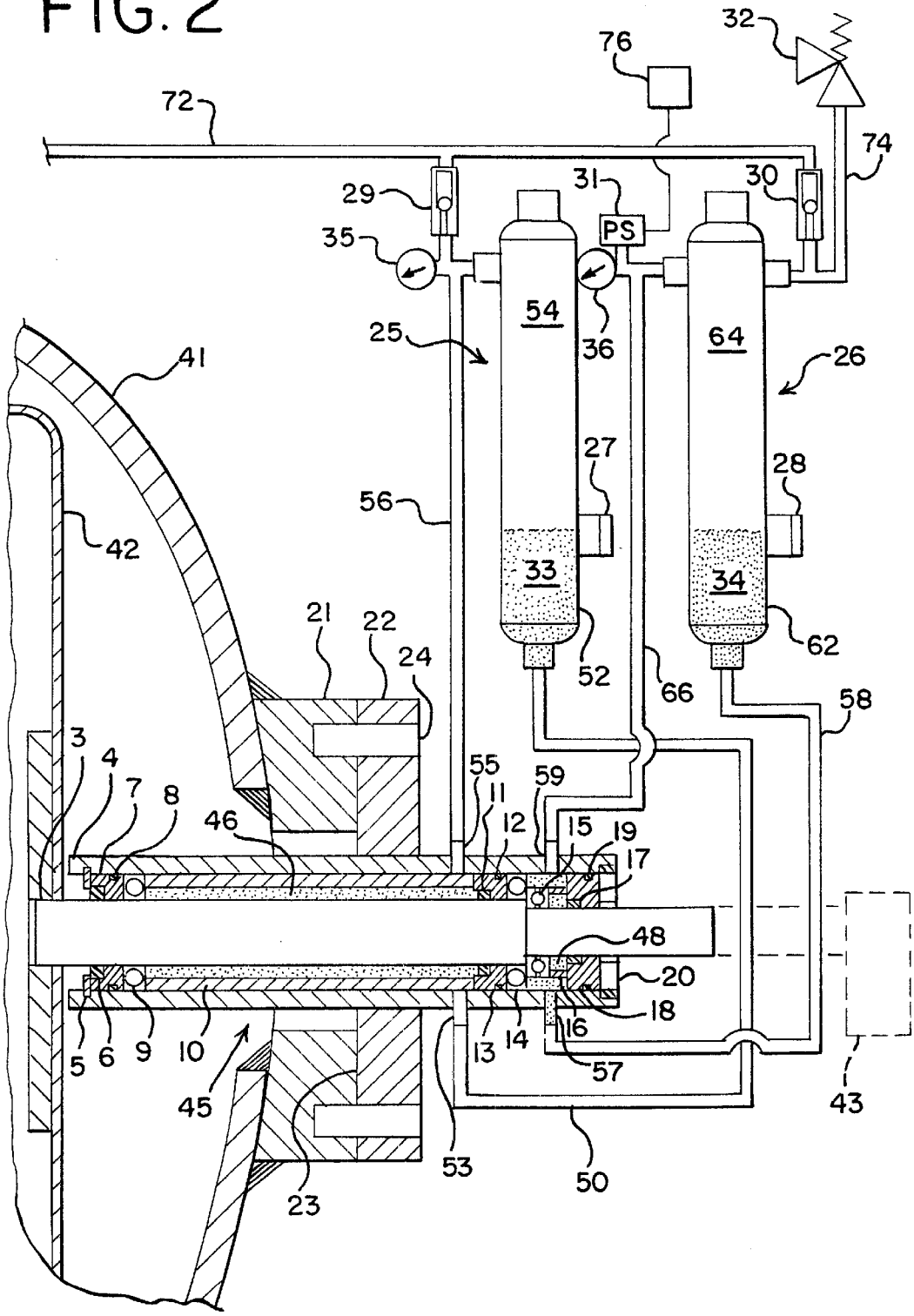
FIG. 2 is an enlarged schematic diagram of the shaft seal system with leak management of FIG. 1.

With reference to FIG. 2, the shaft for rotating the basket 42 is illustrated at 3. The end of the shaft opposite the basket is connected to an electromechanical drive system, indicated in phantom at 43. Electro-mechanical drive system 43 includes an electric motor and a connection between the motor and the shaft 3 such as gears, belts, chains or a direct connection. Motors other than electric motors may alternatively be utilized. The shaft is supported by inboard and outboard bearings 9 and 14, respectively. Thrust bearing 15 prevents movement of the shaft in a longitudinal direction. Inboard bearing 9 is placed close to basket 42 to minimize the forces acting on bearings 9 and 14 due to the weight of the basket, the weight of the items in the basket, the spinning basket and the agitation of the items in the basket.

A portion of the shaft 3, including the portion passing through the wall of cleaning vessel 41, is enclosed within seal and bearing cartridge, indicated in general at 45. The cartridge features a housing 4 that is welded to a circumferential flange 22. Flange 22 is secured to cleaning vessel boss 21 via bolts 24. As a result, cartridge 45 remains fixed relative to spinning shaft 3. Gasket material 23 is disposed between flange 22 and boss 21.

A primary seal 6, its annular retainer 7 and o-ring 8 are secured within cartridge housing 4 and adjacent to inboard bearing 9 by inside retainer ring 5. The primary seal 6 is positioned between the shaft 3 and annular retainer 7 while o-ring 8 is positioned between retainer 7 and cartridge housing 4. Annular retainer 7 and, of course, bearing 9, remain fixed relative to spinning shaft 3. It is to be understood that alternative sealing arrangements may be utilized.

Near the opposite end of the cartridge housing 4 is a secondary seal 11, its annular retainer 12 and o-ring 13 (positioned to the left of outboard bearing 14). A spacer 10 is positioned between the inboard bearing 9 and retainer 12. The secondary seal 11 is positioned between the shaft 3 and annular retainer 12 while o-ring 13 is positioned between retainer 12 and cartridge housing 4. Annular retainer 12 and, of course, bearings 14 and 15, remain fixed relative to spinning shaft 3.

A final seal 17, its annular retainer 18 and o-ring 19 are positioned to the right of a spacer 16 that abuts thrust bearing 15 and are secured in position via circular and threaded end plate 20. The final seal 17 is positioned between the shaft 3 and annular retainer 18 while o-ring 19 is positioned between retainer 18 and cartridge housing 4. The annular retainer 18 of final seal 17 remains fixed relative to shaft 3.

An inboard or primary annular oil chamber 46 is defined between the primary seal assembly and the secondary seal assembly while an outboard or secondary annular oil chamber 48 is defined between the secondary seal assembly and the final seal assembly. The primary oil chamber 46 houses spacer 10 while the secondary oil chamber 48 houses spacer 16. Both annular oil chambers are at atmospheric pressure if the primary, secondary and final seals are fully intact.

Primary oil chamber 46 communicates via inlet fitting 53 and line 50 with the liquid side 52 of a primary tank, indicated in general at 25, containing a supply of lubricating oil 33. Alternative lubricants or fluids may be substituted for oil 33. Primary chamber 46 also communicates with the head space 54 of the primary tank via outlet fitting 55 and line 56. Similarly, secondary oil chamber 48 communicates via line 58 and inlet fitting 57 with the liquid side 62 of a secondary tank, indicated in general at 26, containing a supply of lubricating oil 34. Secondary chamber 48 also communicates with the head space 64 of secondary tank 26 via line 66 and outlet fitting 59. As a result, oil chambers 46 and 48 are at least partially filled with oil so that bearings 9, 14 and 15 are constantly lubricated. Sight glasses 27 and 28 allow the oil levels in the tanks to be monitored.

If a leak occurs across the primary seal 6, the carbon dioxide that escapes from the cleaning vessel into oil chamber 46 is vaporized. The vaporized carbon dioxide travels through line 56 so that the head space 54 of tank 25 is pressurized. As a result, the pressure differential across the leaking primary seal 6 is minimized. When the cleaning vessel is depressurized at the end of the wash cycle, the carbon dioxide gas in the top of tank 25 is returned to the cleaning vessel via check valve 29 and line 72 (see FIG. 1). As such, tank 25 essentially "catches and stores"the carbon dioxide gas from small leaks across the primary seal 6.

Small leaks in the secondary seal 11 will be oil from primary oil chamber 46. Only large leaks across secondary seal 11 would include carbon dioxide gas. A pressure switch 31 is in communication with secondary oil chamber 48 via line 66 and has a pressure setting that is low enough to detect leakage of oil from primary oil chamber 46 to secondary oil chamber 48. Such a pressure setting could be, for example, 50 psig. Pressure switch 31 is in communication with either the control system or a signal device 76. When the pressure setting of pressure switch 31 is exceeded, signal device 76 is activated to provide an alarm that the secondary seal has been breached. The signal device may provide an audio alarm, visual alarm or both. Alternatively, the signal device may be integrated into the control system for the carbon dioxide dry cleaning system so that the control system provides an indication that the secondary seal has been breached.

Carbon dioxide gas that leaks past secondary seal 11 would travel through line 66 so that the head space 64 of tank 26 is pressurized thereby minimizing the pressure differential across the leaking seal secondary seal 11. As previously described for check valve 29, when the cleaning vessel is depressurized, the carbon dioxide gas in the top of tank 26 is returned to the cleaning vessel via ball lift check valve 30 and line 72.

Pressure gauges 35 and 36 indicate a pressure buildup in tanks 25 and/or 26 indicating a leak in the primary and/or secondary seals is present. The pressure gauge readings also assist in quantifying the size(s) of the leak(s). Pressure gauge 36 is capable of indicating small oil leaks across secondary seal 11, but has no alarm or notification feature thereby necessitating pressure switch 31. A pressure control valve 32 opens at, for example, 100 psi, and vents the carbon dioxide gas outside of the facility housing the system via line 74 when the pressure in either tank becomes too great. The configuration of tanks 25 and 26 and lines 72 and 74 allow the venting to occur without the loss of lubricating oil 33 and 34.

Seals 6, 11, and 17 preferably have pressure ratings that are approximately twice the maximum vessel working pressure so leaks are not anticipated routinely. A variety of suitable seals are known in the art and are commercially available. For example, suitable seals may be obtained from Balseal Engineering.

The present invention therefore allows leaks to be handled with minimal and delayed impact on dry cleaning operations. If or when a leak develops across the primary seal 6, it will begin gradually and initially be small. As a result, all of the leaked carbon dioxide will be contained in the tank 25 and will be returned to the cleaning vessel 41 during the gas recovery and drying cycle. The leakage rate would also be minimized because of the decrease in pressure differential across the primary seal 6. The relatively low pressure permitted in secondary chamber 48, as monitored by pressure switch 31, imposes hardly any load at all on the final seal 17, thus minimizing the likelihood that it would ever leak. In the event of a large leak across secondary seal 11, the flow of carbon dioxide gas would be minimized due to the operation of tank 26 and lines 58 and 62.

The pressure gauges 35 and 36, and signal device 76, indicate leakage of the primary and secondary seals and also indicate how serious a leak is. Because of the "self healing" features of the invention, small leaks do not require immediate attention with concurrent loss of productivity of the equipment. Small leaks in the primary seal should be able to be ignored until they become significantly large or leakage of the secondary seal occurs. Under such circumstances, the seal and bearing cartridge should be serviced or replaced. This maybe easily accomplished by removing bolts 24 so that flange 22 may be removed from boss 23. Cartridge housing 24, and its contents, may then be slid off of shaft 3 as a unit.

While the preferred embodiments of the invention have been shown and described, it will be apparent to those skilled in the art that changes and modifications may be made therein without departing from the spirit of the invention, the scope of which is defined by the appended claims.

What is claimed is:

1. A system for sealing a rotating shaft as it enters a pressurized cleaning vessel containing a solvent comprising:

a) a housing surrounding said shaft as it enters the cleaning vessel;

b) a primary seal disposed between the shaft and the housing and a secondary seal disposed between the shaft and the housing and spaced from the primary seal so that a primary chamber is defined therebetween;

c) a primary tank containing a supply of fluid with a head space thereabove, the head space of said primary tank and a wet side of said primary tank both in communication with the primary chamber;

whereby solvent leaking into the primary chamber is routed to the head space of the primary tank to reduce a pressure differential across said primary seal and reduce the leakage of solvent into the primary chamber.

2. The system for sealing of claim 1 further comprising an inboard bearing supporting the shaft and positioned within the primary chamber and wherein the fluid in said primary tank is a lubricant.

3. The system for sealing of claim 1 further comprising:

d) a final seal disposed between the shaft and the housing and spaced from the secondary seal so that a secondary chamber is defined therebetween; and e) a secondary tank containing a supply of fluid with a head space thereabove, the head space of said secondary tank and a wet side of said secondary tank both in communication with the secondary chamber so that solvent leaking into the secondary chamber is routed to the head space of the secondary tank to reduce a pressure differential across said secondary seal and reduce the leakage of solvent into the secondary chamber.

4. The system for sealing of claim 3 further comprising an outboard bearing supporting the shaft and positioned within the secondary chamber and wherein the fluid in said secondary tank is a lubricant.

5. The system for sealing of claim 4 further comprising a thrust bearing supporting the shaft and positioned within the secondary chamber.

6. The system of claim 3 further comprising a pressure switch having a pressure setting, said pressure switch in communication with the secondary chamber and a signal device so that said pressure switch activates said signal device when a pressure within the secondary chamber exceeds the pressure setting of the pressure switch so that said signal device provides an indication of leakage across the secondary seal.

7. The system for sealing of claim 1 further comprising a primary seal annular retainer with the primary seal disposed between the primary seal annular retainer and the shaft and a primary seal o-ring disposed between the primary seal annular retainer and the housing.

8. The system for sealing of claim 7 further comprising a secondary seal annular retainer with the secondary seal disposed between the secondary seal annular retainer and the shaft and a secondary seal o-ring disposed between the secondary seal annular retainer and the housing.

9. The system for sealing of claim 1 further comprising a flange attached to the housing, said flange adapted to be secured to the cleaning vessel.

10. The system for sealing of claim 1 further comprising a line in communication between the head space of the primary tank and the cleaning vessel.

11. The system for sealing of claim 10 further comprising a check valve disposed in said line between the head space of said primary tank and the cleaning vessel so that vapor from the head space of the primary tank may flow to, and oil is prevented from being drawn into, the cleaning vessel when it is de-pressurized.

12. The system for sealing of claim 1 further comprising a pressure gauge in communication with said primary tank.

13. The system for sealing of claim 1 further comprising a pressure relief valve in communication with said primary tank.

14. A system for cleaning items with solvent comprising:

a) a pressurized cleaning vessel containing the solvent;

b) a rotatable basket disposed within the cleaning vessel for containing the items to be cleaned;

c) a shaft connected between the rotatable basket and a drive system, said shaft rotatable relative to the cleaning vessel;

d) a housing surrounding said shaft as it enters the cleaning vessel;

e) a primary seal disposed between the shaft and the housing and a secondary seal disposed between the shaft and the housing and spaced from the primary seal so that a primary chamber is defined therebetween;

f) a primary tank containing a supply of fluid with a head space thereabove, the head space of said primary tank and a wet side of said primary tank both in communication with the primary chamber;

whereby solvent leaking into the primary chamber is routed to the head space of the primary tank to reduce a pressure differential across said primary seal and reduce the leakage of solvent into the primary chamber.

15. The system for cleaning of claim 14 further comprising an inboard bearing supporting the shaft and positioned within the primary chamber and wherein the fluid in said primary tank is a lubricant.

16. The system for cleaning of claim 14 further comprising:

g) a final seal disposed between the shaft and the housing and spaced from the secondary seal so that a secondary chamber is defined therebetween; and h) a secondary tank containing a supply of fluid with a head space thereabove, the head space of said secondary tank and a wet side of said secondary tank both in communication with the secondary chamber so that solvent leaking into the secondary chamber is routed to the head space of the secondary tank to reduce a pressure differential across said secondary seal and reduce the leakage of solvent into the secondary chamber.

17. The system for cleaning of claim 16 further comprising an outboard bearing supporting the shaft and positioned within the secondary chamber and wherein the fluid in said secondary tank is a lubricant.

18. The system for cleaning of claim 17 further comprising a thrust bearing supporting the shaft and positioned within the secondary chamber.

19. The system for cleaning of claim 16 further comprising a pressure switch having a pressure setting, said pressure switch in communication with the secondary chamber and a signal device so that said pressure switch activates said signal device when the pressure setting of the pressure switch is exceeded by a pressure in the secondary chamber so that said signal device provides an indication of leakage across the secondary seal.

20. The system for cleaning of claim 14 further comprising a primary seal annular retainer with the primary seal disposed between the primary seal annular retainer and the shaft and a primary seal o-ring disposed between the primary seal annular retainer and the housing.

21. The system for cleaning of claim 20 further comprising a secondary seal annular retainer with the secondary seal disposed between the secondary seal annular retainer and the shaft and a secondary seal o-ring disposed between the secondary seal annular retainer and the housing.

22. The system for cleaning of claim 14 further comprising a flange attached to the housing and a boss positioned upon said cleaning vessel, said flange removably secured to the boss of said cleaning vessel.

23. The system for cleaning of claim 14 further comprising a line in communication between the head space of the primary tank and the cleaning vessel.

24. The system for cleaning of claim 23 further comprising a check valve disposed in said line between the head space of said primary tank and the cleaning vessel so that solvent vapor from the head space of the primary tank may flow to, and oil is prevented from being drawn into, the cleaning vessel when the cleaning vessel is de-pressurized.

25. The system for cleaning of claim 14 further comprising a pressure gauge in communication with said primary tank.

26. The system for cleaning of claim 14 further comprising a pressure relief valve in communication with said primary tank.

27. A seal and bearing cartridge for supporting and sealing a rotating shaft as it enters a pressurized vessel containing solvent and for communicating with a wet side and a head space of a tank containing a supply of lubricant comprising:

a) a tubular cartridge housing;

b) a primary seal and a secondary seal secured within said cartridge housing and adapted to receive the shaft;

c) said primary seal spaced from said secondary seal so that when the cartridge is mounted on the shaft, a chamber is defined;

d) a bearing secured within said cartridge housing between said primary and secondary seals and positioned within said chamber;

e) said cartridge housing including inlet and outlet fittings in communication with the chamber; and f) said inlet and outlet fittings adapted to communicate with the wet side and the head space, respectively, of the tank;

whereby said bearing is lubricated and solvent leaking into the chamber is directed to the head space of the tank so that a pressure differential across the primary seal is minimized.

* * * * *